US010814217B2

(12) United States Patent
Rogow-Patt et al.

(10) Patent No.: US 10,814,217 B2
(45) Date of Patent: Oct. 27, 2020

(54) SPINNING TOY

(71) Applicants: Gabriel Rogow-Patt, Northridge, CA (US); Bradley Patt, Northridge, CA (US)

(72) Inventors: Gabriel Rogow-Patt, Northridge, CA (US); Bradley Patt, Northridge, CA (US)

( * ) Notice: Subject to any disclaimer, the term of this patent is extended or adjusted under 35 U.S.C. 154(b) by 0 days.

(21) Appl. No.: 15/997,659

(22) Filed: Jun. 4, 2018

(65) Prior Publication Data

US 2018/0345127 A1 Dec. 6, 2018

Related U.S. Application Data

(60) Provisional application No. 62/514,692, filed on Jun. 2, 2017.

(51) Int. Cl.

| | |
|---|---|
| ***A63F 9/16*** | (2006.01) |
| ***A63H 31/02*** | (2006.01) |
| ***A63H 1/30*** | (2006.01) |
| ***A63H 1/00*** | (2019.01) |

(52) U.S. Cl.

CPC ..... *A63F 9/16* (2013.01); *A63H 1/00* (2013.01); *A63H 1/30* (2013.01); *A63H 31/02* (2013.01)

(58) Field of Classification Search

CPC .. A63H 1/00; A63F 9/14; A63B 63/00; A63B 67/10

See application file for complete search history.

(56) References Cited

U.S. PATENT DOCUMENTS 616,244 A * 12/1898 Meyer ..... A63H 1/06 446/241
1,482,976 A * 2/1924 Downey ..... A63H 27/04 472/7
2,395,549 A * 2/1946 Hojnowski ..... A63H 13/20 446/241
2,417,565 A * 3/1947 Norvell ..... A63B 65/12 446/241
2,423,198 A * 7/1947 McClure, Jr. ..... A63B 67/10 446/241
2,462,576 A * 2/1949 Walker ..... A63H 1/00 446/241
2,595,061 A * 4/1952 Downey ..... A63H 27/04 446/241
2,896,926 A * 7/1959 Chapman ..... B01F 7/00058 416/66
2,961,796 A * 11/1960 Wilbur ..... A63H 33/22 446/131
3,202,425 A * 8/1965 Hennik ..... A63F 9/0247 463/50
3,217,446 A * 11/1965 Steiert ..... A63H 33/26 446/138

(Continued)

*Primary Examiner* — Eugene L Kim
*Assistant Examiner* — Christopher Glenn
(74) *Attorney, Agent, or Firm* — Lewis Roca Rothgerber Christie LLP

(57) ABSTRACT

A spinning toy including a base, at least one shaft coupled to the base, and at least one winged object having a hub and a series of wings coupled to the hub. The hub of the winged object is rotatably mountable on the shaft. When the hub is rotatably mounted on the shaft and rotated relative to the shaft, the winged object is configured to move along the shaft toward the base.

18 Claims, 16 Drawing Sheets

(56) References Cited

U.S. PATENT DOCUMENTS

| | | | | | |
|---|---|---|---|---|---|
| 3,246,424 | A * | 4/1966 | Gregory | A63H 27/14 | 446/40 |
| 3,395,482 | A * | 8/1968 | Sarro | A63H 33/00 | 446/241 |
| 3,476,386 | A * | 11/1969 | Bart | A63H 27/04 | 472/11 |
| 3,610,620 | A * | 10/1971 | Stein | A63F 9/14 | 463/69 |
| 4,042,247 | A * | 8/1977 | Harrington | A63F 5/04 | 273/141 A |
| 4,253,657 | A * | 3/1981 | Rozzelle | G10K 1/07 | 446/418 |
| 4,295,832 | A * | 10/1981 | Karell | A63F 9/0098 | 273/456 |
| 4,440,399 | A * | 4/1984 | Smith | A63B 63/06 | 273/348.4 |
| 4,531,736 | A * | 7/1985 | Sahler | A63B 63/00 | 273/112 |
| 5,171,181 | A * | 12/1992 | Freeman | A63H 1/06 | 446/241 |
| 5,906,529 | A * | 5/1999 | Spais | A63B 65/08 | 446/36 |
| 7,441,940 | B2 * | 10/2008 | Vanek | B01F 7/00075 | 366/129 |
| 8,113,904 | B1 * | 2/2012 | Walterscheid | A63H 27/12 | 446/36 |
| 9,616,991 | B2 * | 4/2017 | Wirasnik | B64C 11/28 | |
| 2014/0235380 | A1 * | 8/2014 | Martino | A63B 43/002 | 473/613 |
| 2014/0323009 | A1 * | 10/2014 | Suzuki | A63H 27/12 | 446/37 |

* cited by examiner

SPINNING TOY

CROSS-REFERENCE TO RELATED APPLICATION

The present application claims priority to and the benefit of U.S. Provisional Patent Application No. 62/514,692, filed Jun. 2, 2017, the entire contents of which are incorporated herein by reference.

FIELD

The present disclosure relates generally to spinning toys that may be used by competing players in a game.

BACKGROUND

The toy market has many interactive toys.

Prior trading card games are ones such as the popular "Pokemon" trading card game. In this game, players collect trading cards and play an interactive game where the cards compete producing a winner. However, there is no physical action involved and no action figures involved in the trading card game.

Another toy, one with multiple parts that can be interchanged interactively, is the "Star Wars Bladebuilders Jedi Master Lightsaber". This toy consists of a set of parts that are used to create a sword resembling the "lightsabers" from the "Star Wars" franchise. While the interactive part exchange heightens the interest in such a toy, there is no game involved per se. This is true of many prior art toys, including action figures like "DC Comics Multiverse Batman Figure," or toy cars like "Hot Wheels Hyper Racer with Lights and Sounds—Spin King." Because toys like these don't have a competitive "gaming" aspect, users who buy them become bored with them quickly.

Other prior toys involving gaming include board games with competitive goals, an end point to the competition, and a set of rules governing use of the toy and what constitutes a "win". However, such games do not have the toy aspect of action figures.

Prior toys that utilize spinning figures, action, competition, aspects of trading of figurine components, an arena and a battle include "Beyblade". Beyblade is a game with spinning toys that battle in an arena. Beyblade uses tops that move (in a mostly horizontal plane). They sometimes spin in bowl shaped arenas, the objective being to bump into and thereby slow down the rotation of the other players' spinning tops so that they stop spinning and come to rest. The last top to still be spinning in this toy is the winner.

Another prior battling-type toy is the Hexbug BattleBots. Battlebots is a toy wherein the figures battle in an arena. However, these toys do not have a main spinning feature, nor do they have shafts.

Another battle toy is the "Air Hogs Smash Bots". This prior art toy is similar to Battlebots.

SUMMARY

The present disclosure is directed to various embodiments of a spinning toy. In one embodiment, the spinning toy includes a base, at least one shaft coupled to the base, and at least one winged object having a hub and a plurality of wings coupled to the hub. The hub is rotatably mountable on the at least one shaft. When the hub is rotatably mounted on the at least one shaft and rotated relative to the at least one shaft, the winged object is configured to move along the at least one shaft toward the base.

At least a segment of the shaft may include threads and the hub may include corresponding threads configured to threadedly engage the threads of the shaft.

The shaft may include a threaded segment and an unthreaded segment in which the threaded segment is between the unthreaded segment and the base.

The at least one shaft may include a series of shafts, and the at least one winged object may include a series of winged objects configured to be rotatably mounted on the series of shafts.

When a first winged object of the series of winged objects is mounted on a first shaft of the series of shafts and a second winged object of the series of winged objects is mounted on a second shaft of the series of shafts, the range of movement of the wings of the first winged object overlap with the range of movement of the wings of the second winged object.

Movement of one of the first and second winged objects along a corresponding one of the first and second shafts is configured to interfere with movement of the other winged object along its respective shaft.

The spinning toy may include a launcher configured to rotate the at least one winged object relative to the at least one shaft.

The hub of the at least one winged object may define a series of openings. The launcher may include a body, a series of blades extending from a first side of the body configured to extend into the series of openings defined in the hub, a rotating slider operably coupled to the series of blades, and a slider operably coupled to the series of blades.

When the hub is mounted on the at least one shaft and the series of blades are received in the series of openings in the hub, actuation of the rotating slider is configured to rotate the series of blades relative to the body and to rotate the at least one winged object relative to the at least one shaft, and actuation of the slider is configured to withdraw the series of blades from the series of openings in the hub and to release the at least one winged object from the series of blades.

The launcher may include a glove coupled to a second side of the body opposite to the first side.

The spinning toy may include at least one spring in the launcher of the at least one winged object. Tension from the at least one spring is configured to rotate the at least one winged object relative to the at least one shaft.

Each wing of the series of wings may be configured to move between a stowed configuration and a deployed configuration.

Each wing of the series of wings may include a first segment directly connected to the hub and a second segment coupled to the first segment.

The second segment may be at least partially telescopically received in the first segment.

The first segment may be configured to tilt relative to the hub, and the second segment may be configured to tilt relative to the first segment.

At least one wing may be a turbine blade, and the at least one winged object may be configured to rotate relative to the at least one shaft and move along the at least one shaft when the series of wings are subject to an airflow.

The spinning toy may include electrical conductors to transmit energy from a power source to the at least one winged object to rotate the at least one winged object relative to the at least one shaft.

The spinning toy may include at least one spring in the hub of the at least one winged object. Tension from the spring is configured to rotate the at least one winged object relative to the at least one shaft.

The present disclosure is also directed to an embodiment of a spinning toy including a base, a series of shafts coupled to the base, and a series of winged object configured to be rotatably mounted on the series of shafts. Each winged object of the series of winged objects includes a hub and a series of wings coupled to the hub. When the hub of a winged object is rotatably mounted on one of the shafts and is rotated relative to the shaft, the winged object is configured to move along the shaft toward the base.

When a first winged object of the series of winged objects is mounted on a first shaft of the series of shafts and a second winged object of the series of winged objects is mounted on a second shaft of the series of shafts, the wings of the first winged object overlap with the wings of the second winged object.

The present disclosure is also directed to various embodiments of a method of playing a spinning toy game including a base, a series of shafts, and a series of winged objects configured to be rotatably mounted on the series of shafts. In one embodiment, the method includes mounting a first winged object of the series of winged objects on a first shaft of the series of shafts, mounting a second winged object of the series of winged objects on a second shaft of the series of shafts, rotating the first winged object relative to the first shaft, and rotating the second winged object relative to the second shaft. Rotation of the first winged object moves the first winged object along the first shaft toward the base, and rotation of the second winged object moves the second winged object along the second shaft toward the base.

Rotating the first winged object relative to the first shaft may include inserting a series of blades of a launcher into a series of openings defined in a hub of the first winged object, and rotating a rotating slider of the launcher. Rotating the rotating slider rotates the series of blades of the launcher.

The first winged object may include at least one turbine blade, and rotating the first winged object relative to the first shaft may include directing an airflow over the first winged object from an air blower.

Rotating the first winged object relative to the first shaft may include applying an electro-magnetic field to the first winged object and the first winged object may include a ferro-magnetic material.

Rotating the first winged object relative to the first shaft may include supplying an electrical current to a motor in the first winged object.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

The above and other features of the present invention may be more fully understood from the following detailed description, taken together with the accompanying drawings, briefly described below, wherein similar reference characters refer to similar elements throughout and in which.

DETAILED DESCRIPTION

Figure 1:
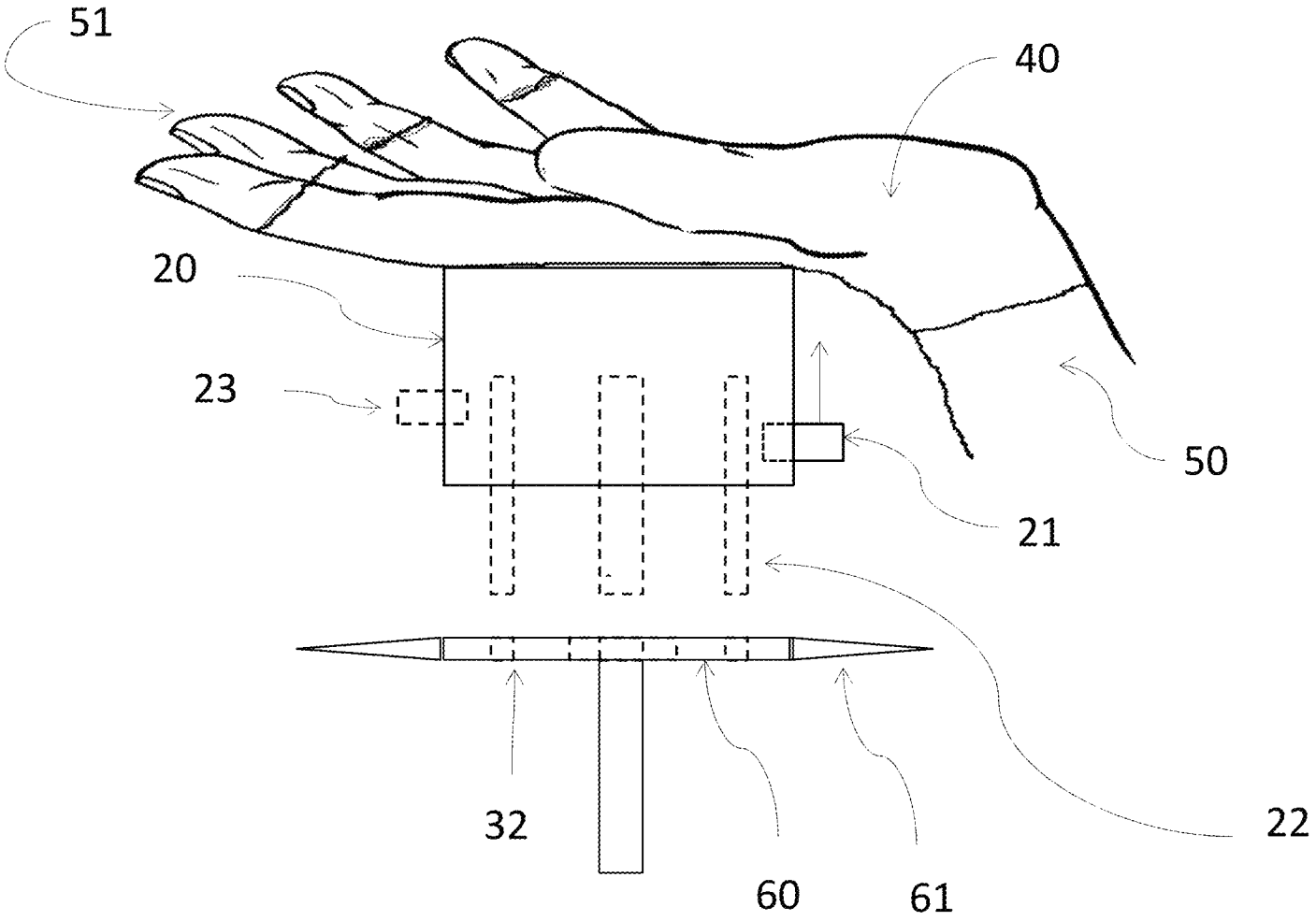
FIG. 1 is a side view the launcher attached to a glove or "glove launcher" after release of the winged object and after utilizing a slider release mechanism to release the winged object. Also depicted is a rotating slider mechanism used to impart energy to the winged object to make it rotate.
Figure 2:
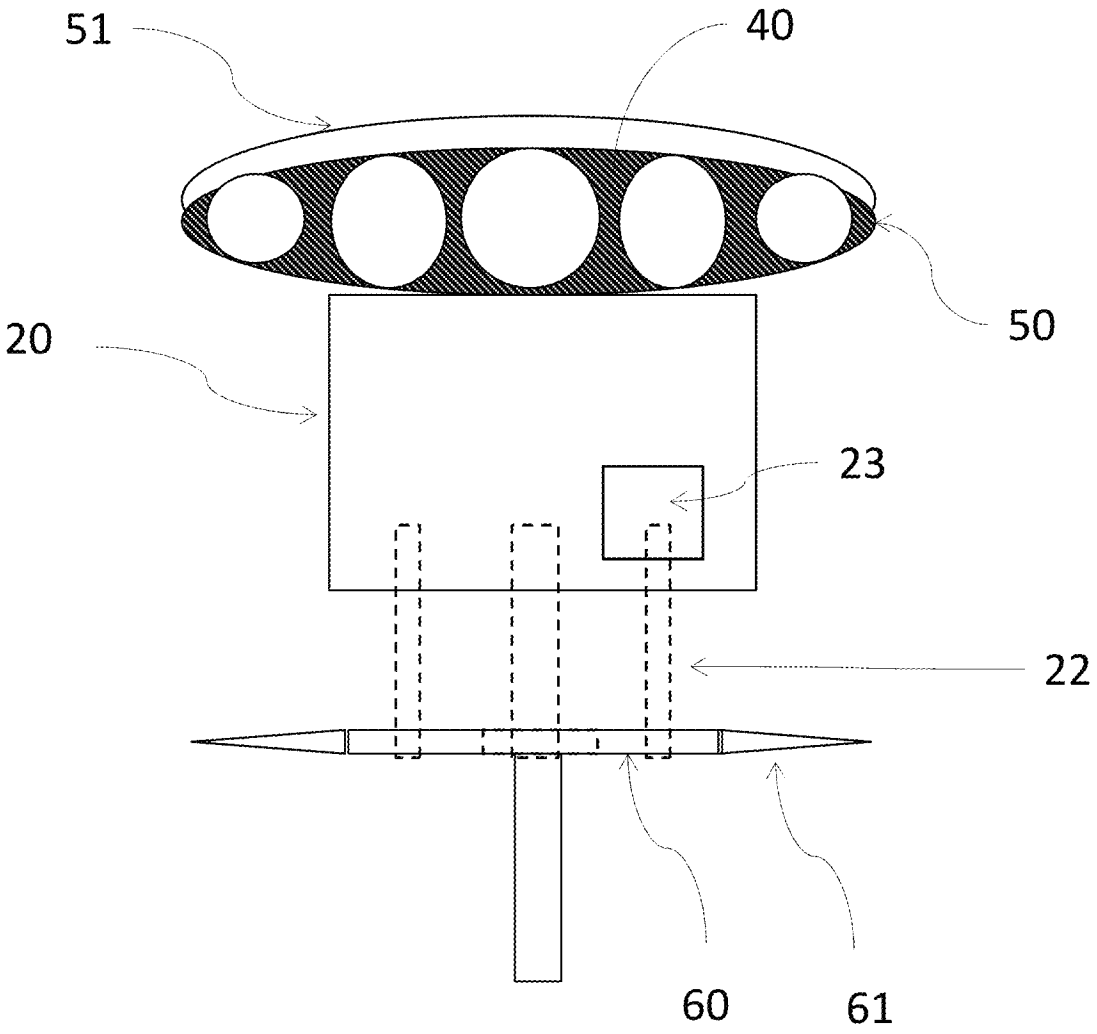
FIG. 2 is a front view of the launcher rotated so that the viewer is looking at the fingertips of the hand and the front view of the rotating slider that is used to build up energy for spinning the winged object.

The present disclosure relates to a physical toy that may be used by competing players in a game. The game may include action figures that spin on corkscrew like shafts with one or more winged objects attached to each shaft that can be made to spin vertically up or down the shafts. The game may be a battle between different players' figures. The end point of the game of the present disclosure may produce a "winner" each time.

In one embodiment of the present disclosure, the spinning toy includes a winged object connected via a hub or nut to a shaft or threaded rod, and the winged object is configured to spin on the shaft. In one embodiment, the goal of the game is to reach the bottom of the rod or shaft in the shortest amount of time. In another embodiment, the goal may be to reach the bottom in the longest amount of time. Various forces (including tension from a spring, electricity, magnetic fields, wind, and other forces that would be known to those skilled in the art) may be applied to spin the object. Various materials (including plastic, rubber, metal, alloys, wood, and others that would be familiar to those skilled in the art) may be used for construction of the shafts, wings, hubs, and winged objects. The deployment of features such as wings of varied shape (including round, square, hexagonal, triangular, shapes designed to enhance either speed, interference, or other aspects, arbitrary shapes, and others known to those skilled in the art) may be used in some cases to enhance the speed and in other cases to interfere with the movement of other winged objects to the bottom of the shaft first, or some other goal.

In another embodiment of the present disclosure, a spinning toy for gaming includes a series of winged objects (e.g., two, three, four or more winged objects) configured to spin on a series of shafts (e.g., threaded rods), such as two, three, four or more shafts. One of the winged objects may spin on one of the shafts next to the other winged objects spinning on the other shafts or threaded rods. In one embodiments, the game includes timing the movement of one of the winged objects from one position or another. The orientation and placement of the rods, separation between the rods, and other geometrical considerations that would be familiar to those skilled in the art may be modified in various embodiments. In one embodiments, the series of winged object may clash with each other and can hit one another with certain goals, such as getting to the top or bottom of the rod, first or last. The winged objects can have different abilities depending on each specific winged object's model. The winged objects also can have wings or other features. The relationship between the rod placement and winged object size and shapes may be varied to enhance various aspects of the competition such as freedom of the winged objects to move along the rods, interference between the winged objects, and other features that will be apparent to those skilled in the art. In addition, the present disclosure is a toy whose parts can be interchanged interactively and traded to foster the competition and enjoyment of the toy.

The spinning toy of the present disclosure surpasses prior games and toys because it has action, figures, a competition, and a winner. It deploys the spinning toy on a shaft, so that the objects move along a vertical axis (top to bottom) and have zero horizontal freedom of movement beyond the width of the unfolded gaming winged objects spinning on the shaft piece. This feature of the spinning toy of the present disclosure makes the toy safer for use than in one where the spinning tops have virtually unimpeded horizontal freedom of movement. Additionally, because the horizontal motion is restricted in the spinning toy of the present disclosure, the player can impart significantly more momentum to the winged object before releasing the winged object down the shaft without increasing the safety risk to the player. In contrast, prior art toys, such as Beyblade, must limit the charge and release mechanism in a tighter safety range.

In one embodiment of the present disclosure, a spinning toy that may be used by competing players in a game includes a winged object 60 and a main shaft or rod 70. The winged object 60 contains a hub 31 configured to spin on the shaft 70. The hub 31 defines a central opening configured (e.g., sized and shaped) to receive the shaft 70. In one or more embodiments, the central opening defined in the hub 31 is threaded. The winged object 60 also includes at least one wing 61 coupled to the hub 31. In one embodiment, the winged object 60 moves along the shaft 70 as the hub 31 of the winged object 60 spins on the shaft 70. In one embodiment, the goal of the game is to reach the bottom of the shaft or rod 70 in the shortest amount of time. Various forces (including tension from a spring, electricity, magnetic fields, wind, and other forces that would be known to those skilled in the art) may be applied to spin the winged object 60 on the shaft 70. Various materials (including plastic, rubber, metal, alloys, wood, and others that would be familiar to those skilled in the art) may be used for construction of the shaft 70 and the winged object 60.

The deployment of various features such as a launcher 20, wings 61 of varied shape (including round, square, hexagonal, triangular, shapes designed to enhance either speed, interference, or other aspects, arbitrary shapes, and others known to those skilled in the art) may be used in some cases to enhance the speed and in other cases to interfere with the movement of other winged objects 60 to the bottom of the shaft 70 first, or some other goal. In some embodiments various components of the wings 61 may be removed and interchanged with other wing components. The present disclosure allows players to deconstruct the winged objects 60 and "mix-and-match" various parts (e.g., the wings 61) in order to allow broader possibilities and wider range of competitive parameters for the player, whereas prior art toys, such as the Hexbug BattleBots and "Air Hogs Smash Bots," do not. A further limitation of prior art toys such as the "Air Hogs Smash Bots" is that the level of action is very limited. The various interchangeable winged components may be of different shapes, sizes, materials, or contain other features that may modify the force the winged object 60 can utilize for its action, speed, deployment, extending elements, or other features to enhance competition that would be familiar to those skilled in the art. In some cases, an aspect of the game is the trading of the interchangeable elements of the wings 61. In certain embodiments of the present invention, the wings 61 may be constructed of rugged materials to sustain impact during play. In other embodiments of the invention the wings 61 may be constructed or assembled to intentionally come apart upon collision with other winged objects 60 for safety or to enhance the game. For example, if a winged object 60 has a multiplicity of wings 61 or other motive elements, the loss of one wing 61 or motive element during a collision could hamper the ability of the winged object 60 from moving as quickly and competing as effectively.

In one embodiment of the present disclosure shown in FIG. 1, the launcher 20 includes a body portion, a series of blades 22 extending from one end (e.g., a lower end) of the body portion, a glove 40 coupled to another end (e.g., an upper end) of the body portion, a rotating slider 23 rotatably coupled to the body portion, and a slider 21 coupled to the body portion. In the illustrated embodiment, the rotating slider 23 is coupled to a first side (e.g., a left side) of the body portion, and the slider 21 is coupled to a second side (e.g., a right side) of the body portion opposite to the first side of the body portion, although in one or more embodiments the rotating slider 23 and the slider 21 may be located in any other suitable positions on the body portion of the launcher 20. In the illustrated embodiment, the launcher 20 includes three blades 22 forming a triangle shape protruding from the launcher 20, although in one or more embodiments, the launcher 20 may include any other suitable number of blades 22 and the blades 22 may be arranged in any other suitable configuration.

The blades 22 of the launcher 20 are configured to hold up the winged object 60, impart spin to the winged object 60, and then release the winged object 60 from the launcher 20 onto the shaft 70 (e.g., the winged object 60 may be attached to the launcher 20 in such a way that the launcher 20 can spin the winged object 60 and also be able to release the winged object 60 as soon as the gamer actuates the slider 21 to release the winged object 60). In one or more embodiments, the hub 31 may be mounted on the shaft 70 before the blades 22 of the launcher 20 are inserted into the openings 32 of the hub 31, or the blades 22 of the launcher 20 may be inserted into the openings 32 of the hub 31 and then the hub 31 may be mounted on the shaft 70. To spin the winged object 60 utilizing the launcher 20, the blades 22 of the launcher 20 are inserted into openings 32 defined in the hub 31 of the winged object 60. The player may then actuate (e.g., rotated) the rotating slider 23. As the rotating slider 23 is actuated, the blades 22 of the launcher 20 rotate relative to the body portion of the launcher 20. In one or more embodiments, the actuation of the rotating slider 23 is configured to coil a coiled spring, and the energy stored in the coiled spring is configured to rotate the blades 22. In one or more embodiments, the actuation of the rotating slider 23 is configured to actuate an electric motor that rotates the blades 22. In one or more embodiments, the actuation of the rotating slider 23 may actuate a pneumatic system that rotates the blades 22 via forced air. In one or more embodiments, the rotating slider 23 may rotate the blades 22 with any other suitable mechanism (e.g., an alternative power source known to those skilled in the art may be utilized to rotate the blades 22 of the launcher 20). The rotation of the blades 22, which engage the winged object 60 via the openings 32 in the hub 31 of the winged object 60, rotate the winged object 60. Once the winged object 60 is rotating with the desired speed, the user may actuate (e.g., slide) the slider 21. Actuation of the slider 21 releases the winged object 60 from the launcher 20. In one embodiment, actuation of the slider 21 is configured to retract the blades 22 into the body portion of the launcher 20. Once the winged object 60 has been released from the launcher 20, the engagement between the rotating winged object 60 and the shaft 70 causes the winged object 60 to move along (e.g., downward) along the shaft 70.

The glove 40 is configured to be worn on the hand 50 of the player. In one embodiment, the glove 40 is permanently attached to the launcher 20. In other embodiments, the glove 40 is attached to the launcher 20 by hook and loop type fasteners (e.g., Velcro™) or some other semi-permanent or non-permanent attachment mechanism. In various embodiments of the present disclosure, the glove 40 can be made of plastic, fiber material, leather or other material, and the choice of material can be used to present gamers with various optional gloves at various price points in the market. In the illustrated embodiment, the glove 40 is a fingerless glove such that when the player's hand 50 is inserted into the glove 40, the player's fingertips 51 protrude from the glove 40. The fingerless glove 40 allows the player to use their fingertips 51 to manipulate the elements of the launcher 20, including the rotating slider 23 to spin the winged object 60 and the slider 21 to release the winged object 60 (FIG. 4).

Figure 3:
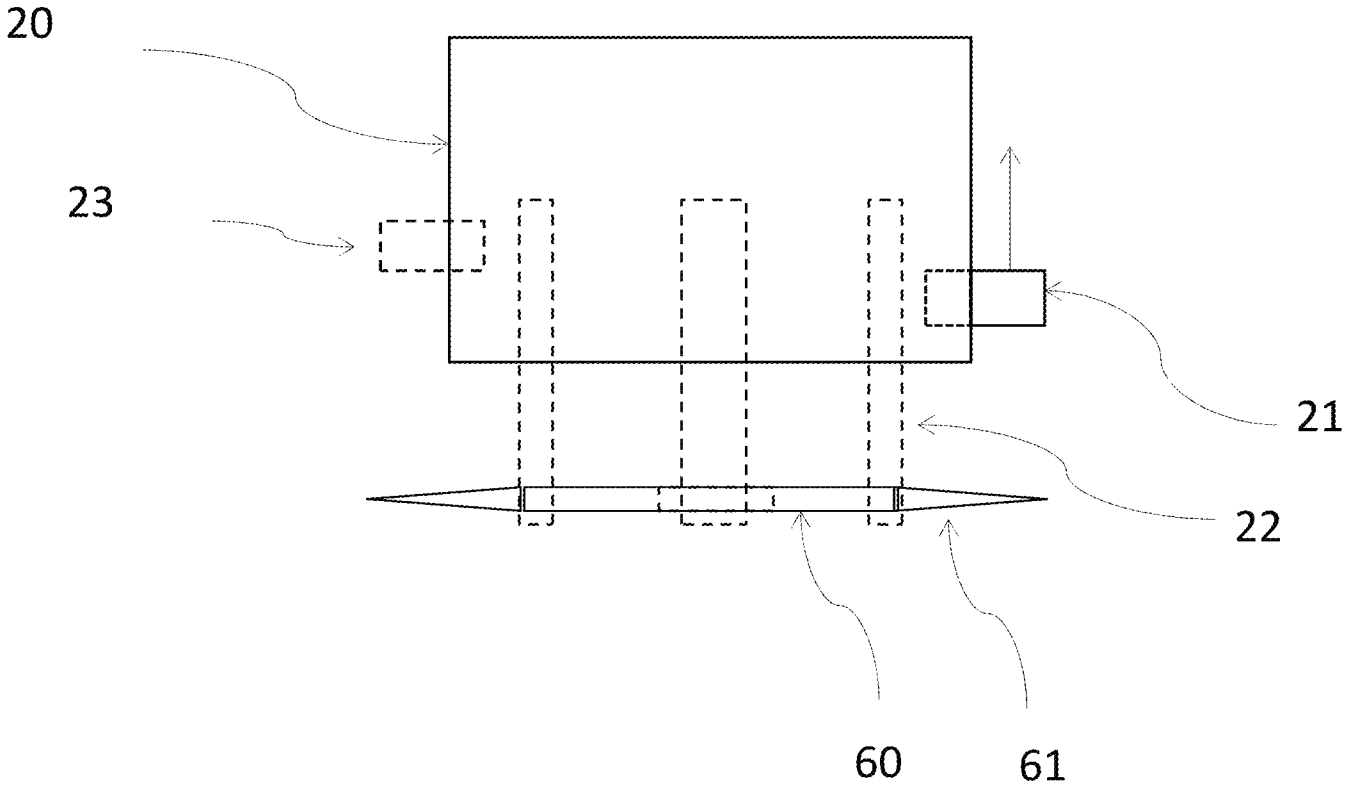
FIG. 3 shows the launcher attached to the winged object via the blades of the winged object that are used to hold up and release the winged object.

FIG. 3 shows another embodiment of the launcher 20 from the same direction as FIG. 1 except it is not identical to the embodiment illustrated in FIG. 1 because it does not use the same holding method and does include the glove 40 and hand 50. In the illustrated embodiment, the gamer holds the launcher 20 with one hand and uses the other hand to operate the rotating slider 23 and the release slider 21.

Figure 4:
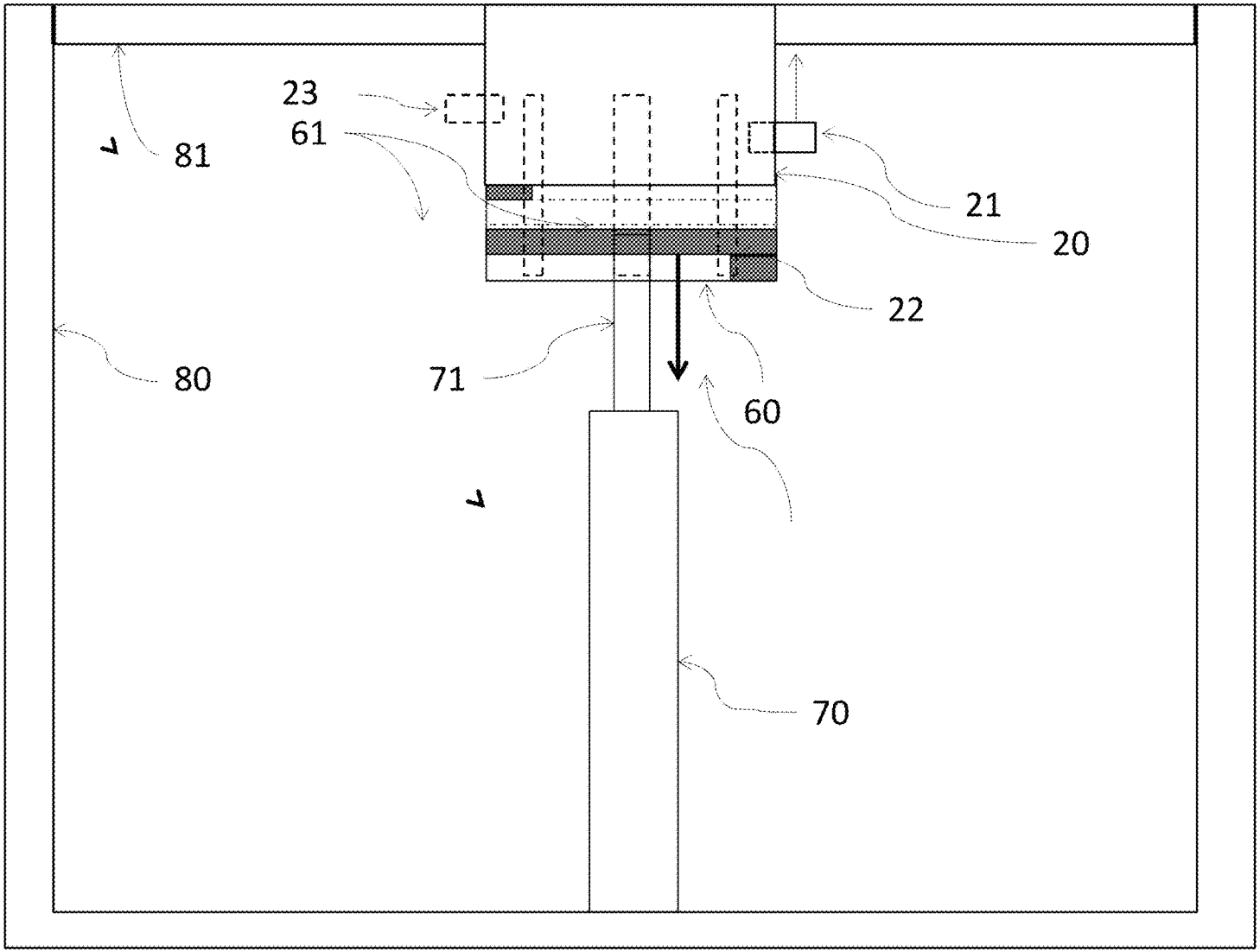
FIG. 4 shows the launcher inside the arena and the shaft on which the winged object spins showing the two section of the shaft, the thinner section used to deploy the winged object and the main section on which the winged object then spins. The blades are keeping up the winged object and it is ready to launch.

FIG. 4 shows another embodiment of the present invention in which the launcher 20 is shown inside an arena 80 from the same perspective as FIG. 3 with the winged object 60 attached to the launcher 20 via the blades 22 ready to launch. In the illustrated embodiment, the arena 80 has box-like features with one or more shafts or rods in it and an area designated to place the launcher 20. In one or more embodiments, the arena 80 may have other features such as a power source to facilitate operation of the winged object 60. Additionally, in the illustrated embodiment, one or more of the shafts may include an unthreaded segment 71 and a threaded segment 70. In the illustrated embodiment, the unthreaded segment 71 is smaller (e.g., has a smaller diameter) than the threaded segment 70. In one embodiment, the arena 80 can be made of a clear plastic in order to allow users to see into the arena 80 to monitor play. In another embodiment, the arena 80 can be made of an opaque material and may employ cameras or other means to allow users to monitor the action in the arena 80 to monitor play. In the illustrated embodiment, the launcher 20 is attached to the arena 80 via extensions 81 of the arena. In one manner of using the present disclosure, the wings 61 of the winged object 60 are used to compete with the winged object 60 of an opponent. In an embodiment, the winged object 60 is spun using the rotating slider 23 and released using the release slider 21 so that it can fall down the unthreaded segment 71 of the shaft and onto the threaded segment 70 of the shaft on which the winged object 60 will then spin down and battle other winged objects 60 in some uses of the present disclosure.

Figure 5:
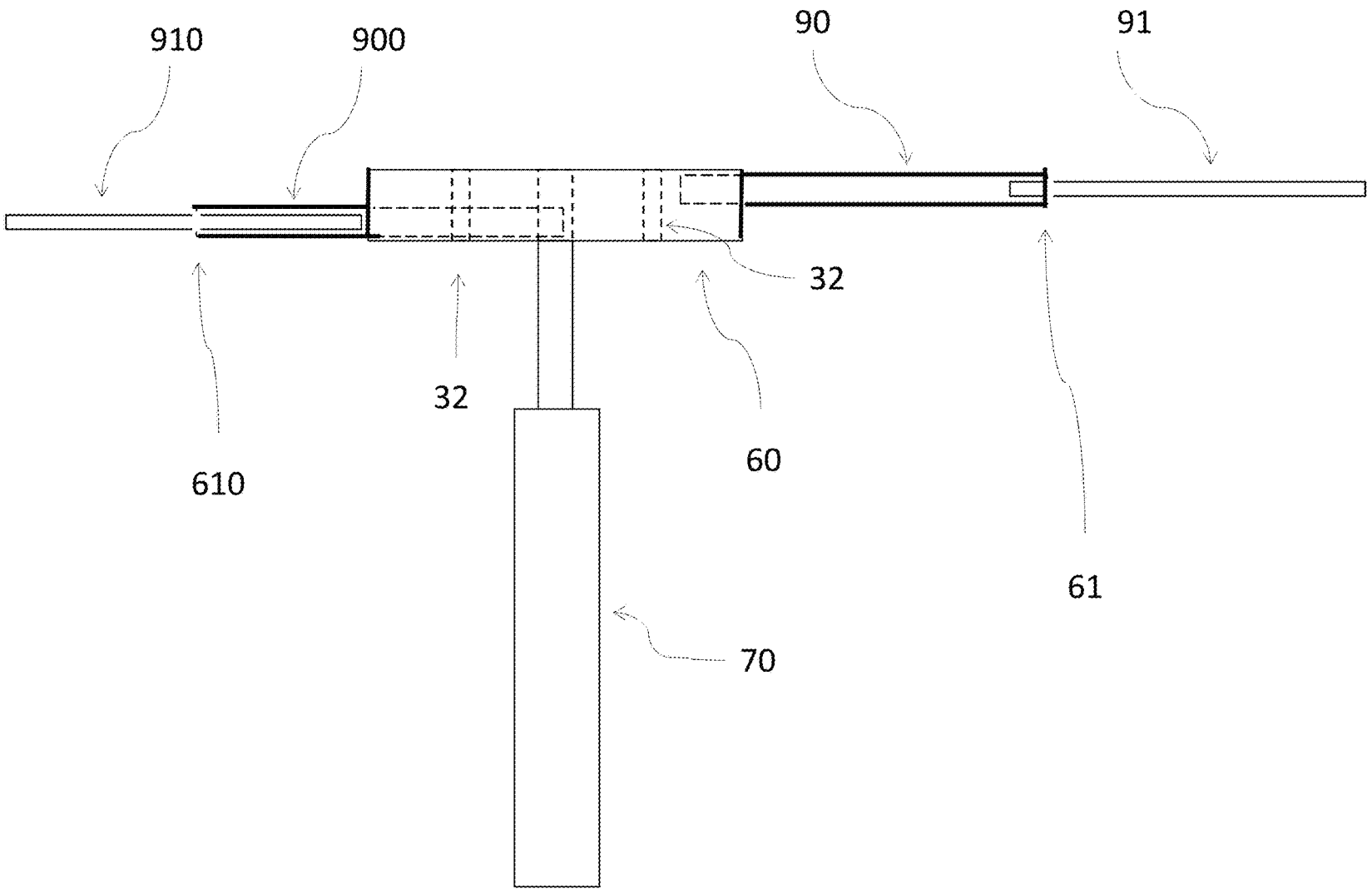
FIG. 5 is a side view of the winged object on the thin shaft ready to launch. It shows the telescoping wings, one of which is halfway extended (left) and the other is fully extended (right).
Figure 6:
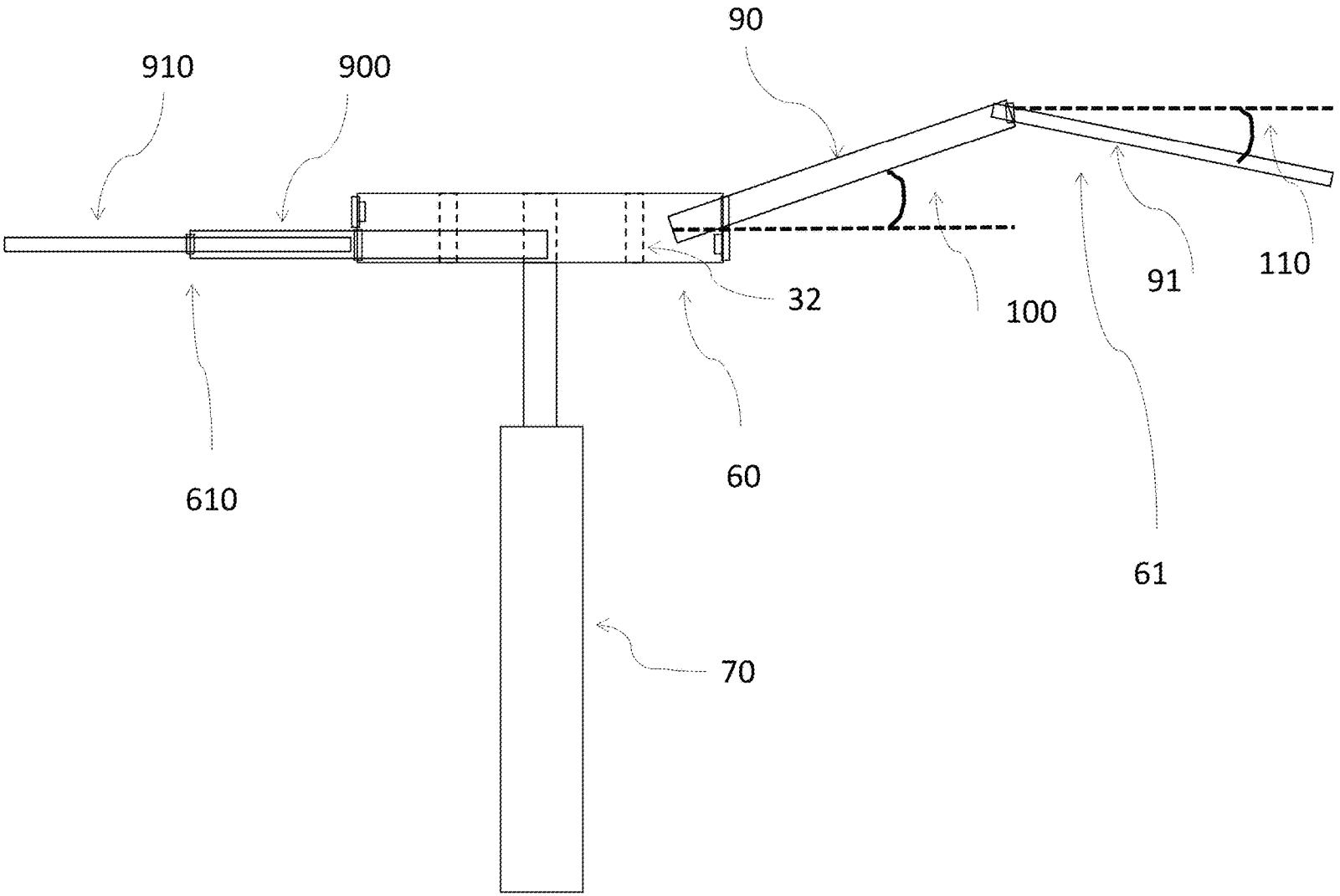
FIG. 6 is a side-view of the winged object on the thin shaft ready to launch. It shows the telescoping wings, which have the ability to tilt. The left wing is halfway extended. The right wing is fully extended and tilted at the joints between the telescoping wing sections.

With reference now to the embodiment illustrated FIGS. 5 and 6, the wings 61 of the winged object 60 are configured to extend (e.g., telescope) and/or tilt up and down. In the embodiment illustrated in FIG. 5, one of the wings 61 (e.g., the right wing) includes an inner segment 90 coupled (e.g., directly coupled) to the hub 31 and an outer segment 91 slidably (e.g., telescopically) coupled to the inner segment 90. In the illustrated embodiment, the inner segment 90 is configured to move between a stowed configuration in which the inner segment 90 extends into the hub 31 by a first distance and an extended configuration in which the inner segment 90 extends into the hub 31 by a second distance less than the first distance. In the illustrated embodiment, the inner segment 90 is a hollow member. In the illustrated embodiment, the outer segment 91 is configured to move between stowed configuration in which the outer segment 91 extends into the inner segment 90 by a first distance and an extended configuration in which the outer segment 91 extends into the inner segment 90 by a second distance less than the first distance. Additionally, in the illustrated embodiment, another one of the wings 61 (e.g., the left wing) includes an inner segment 900 coupled (e.g., directly coupled) to the hub 31 and an outer segment 910 slidably (e.g., telescopically) coupled to the inner segment 900. In the illustrated embodiment, the inner segment 900 is configured to move between a stowed configuration in which the inner segment 900 extends into the hub 31 by a first distance and an extended configuration in which the inner segment 900 extends into the hub 31 by a second distance less than the first distance. In the illustrated embodiment, the inner segment 900 is a hollow member. In the illustrated embodiment, the outer segment 910 is configured to move between stowed configuration in which the outer segment 910 extends into the inner segment 900 by a first distance and an extended configuration in which the outer segment 910 extends into the inner segment 900 by a second distance less than the first distance. In the illustrated embodiment, the outer segment 91 is configured to extend to an outer end or substantially to the outer end of the inner segment 90, and the outer segment 910 is configured to extend to an outer end or substantially to the outer end of the inner segment 900.

Additionally, in the illustrated embodiment, the inner and outer segments 90, 91 of the right wing 61 and the inner and outer segments 900, 910 of the left wing 61 are straight or substantially straight segments, although in one or more embodiments, one or more of the inner and outer segments 90, 91, 900, 910 may be non-linear (e.g., curved).

In the embodiment illustrated in FIG. 6, the right wing 61 and the left wing 61 of the winged object 60 are each configured to tilt up and down with respect to the hub 31 of the winged object 60. In the illustrated embodiment, the outer segment 91 of the right wing 90 is in the fully extended position and the outer segment 910 of left wing 900 is in a partially extended position (e.g., an approximately half extended position). Additionally, in the illustrated embodiment, the inner segment 90 of the right wing 61 is tilted up (e.g., in a fully tilted up position) with respect to the body portion of the launcher 20 and the outer segment 91 is tilted down with respect to the inner segment 90. In one or more embodiments, the wings 61 may be configured to tilt in any other suitable manner (e.g., the inner segments 90, 900 may be configured to tilt down with respect to the hub 31 and the outer segments 900, 910 may be configured to tilt up with respect to the inner segments 90, 900, respectively).

In one or more embodiments, various pieces can unfold out of the winged object 60 and be of different shapes. In various embodiments of the present disclosure, the winged object 60 may have variable horizontal and vertical dimensions. In various embodiments, the envelope of the winged object 60 may be round, triangular, square, rectangular, trapezoidal, or of other shapes that will be apparent to those skilled in the art, or may employ different features that will be apparent to those skilled in the art. In some embodiments of the present disclosure, the winged objects 60 may be taken apart and various components or features may be interchanged with those of other winged objects 60.

Figure 7:
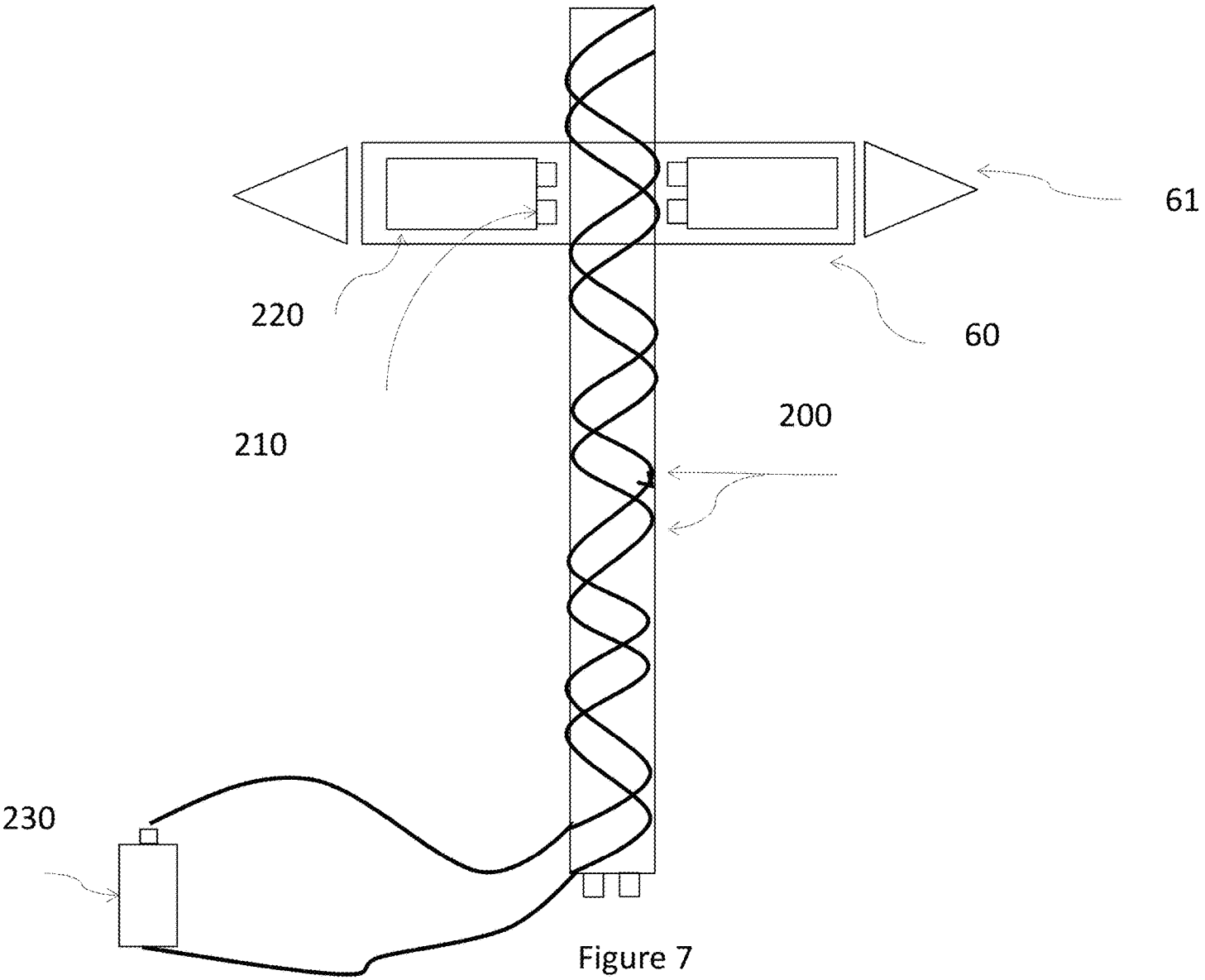
FIG. 7 is a side-view of an embodiment of the invention with electrical power. Wires are run inside of the main shaft with connection points on the outside of the shaft to transfer the energy to an embodiment of the winged object which has conductor prongs on its inside in order to transfer the electricity to mini-energy storage units inside the winged object. These mini-energy storage units can be used to power motors enabling various features of the wings.

FIG. 7 depict an embodiment of a powered spinning toy. In the illustrated embodiment, the spinning toy includes wires 200 (e.g., electrical lines) spiraled around the shaft 70. Additionally, in the illustrated embodiment, the spinning toy includes conductor prongs 210 at least partially housed (e.g., mostly housed) inside the winged object 60 and also protruding from the central opening defined in the hub 31 of the winged object 60. The conductor prongs 210 are configured to contact the wires 200. The wires 200 are connected to power source, such as a battery 230 or an outlet. The conductor prongs 210 are configured to transmit energy from the power source (e.g., the battery 230) into one or two mini-energy storage unit(s) 220 to be used for different reasons depending of the embodiment of the powered spinning toy. For instance, in one or more embodiments, the mini-energy storage units 220 are configured to rotate (e.g., spin) the winged object 60 around the shaft 70. In some embodiments, power supplied from the power source 230 to the winged object 60 via the conductor prongs 210 may provide power to the wings 61 or other features of the winged object 60 facilitating rotation, linear telescoping or other movements. In one or more embodiments, connectors such as brushes or other means may be employed on the winged objects 60 to couple the power source 230 and the wires 200 on the shaft 70 to the winged objects 60. In other embodiments, the power source 230 may be connected to the winged objects 60 via brushless means. In some embodiments, a slip-ring mechanism may be employed to connect the power source 230 to the winged objects 60. In one embodiment of the present disclosure, the power source (e.g., the batteries 230) may be used to provide power to the arena 80.

In certain embodiments of the present disclosure, electricity (e.g., battery power) can be used to enable various features and variety in gameplay. Using remote control or preset patterns, a player could control the wings 61 by extension, rotation, reorientation, or other means in order to interfere with a competitor's motion up or down the shaft 70. The use of remote control in the toy of the present invention provides instantaneous "jumps" in the action, and improves over the slower more tedious flow of prior games. Additionally, the fact that the game is not exclusively remote control, but includes the remote feature in addition to uncontrolled action, allows users to optimize certain aspects of the movement of the winged objects 60 at times simplifying the action and at other times complicating it. Thus the toy can be appealing across age groups with more sophisticated users taking advantage of more of the sophisticated features of the toy.

Figure 8:
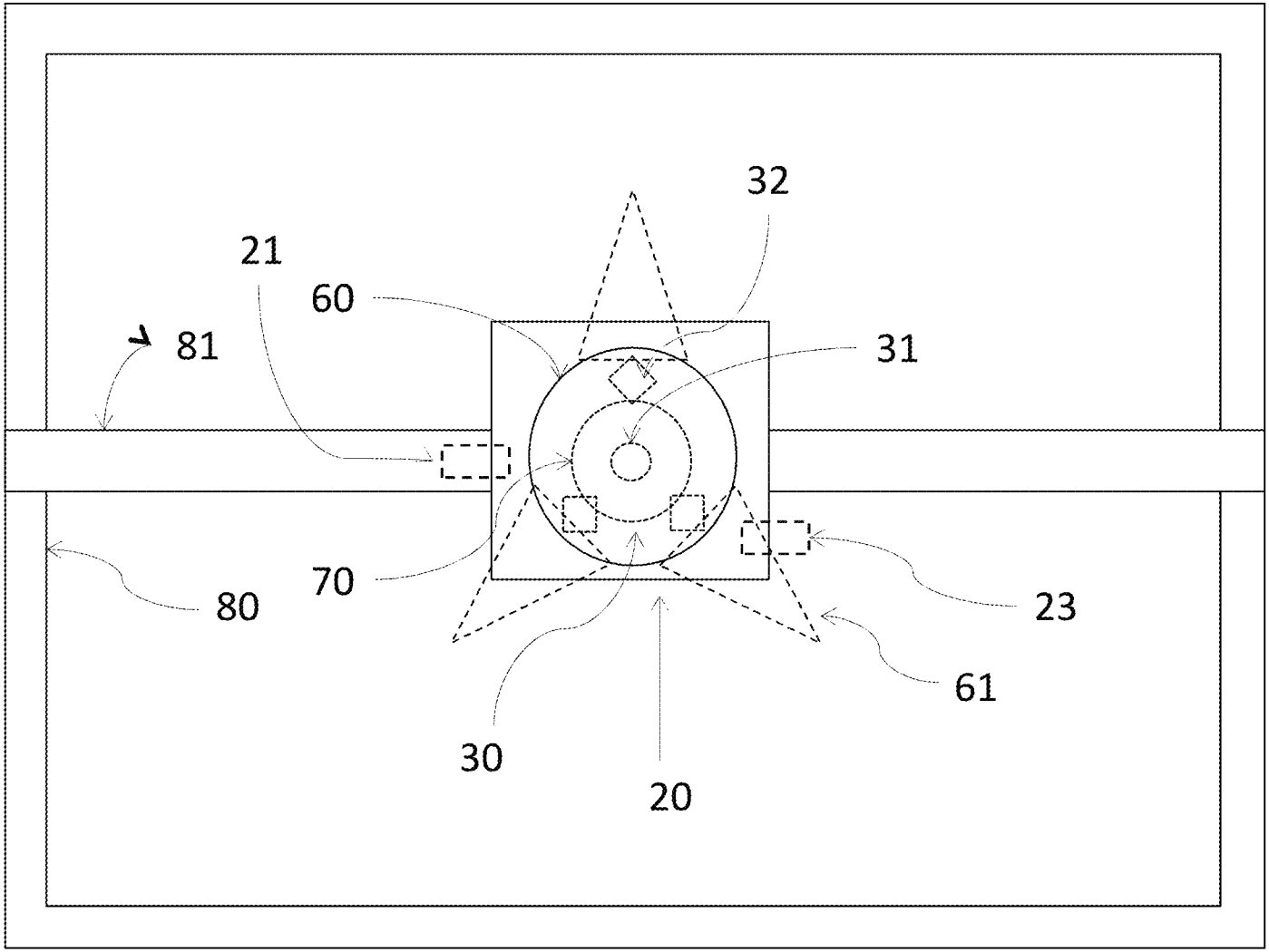
FIG. 8 is a top view of FIG. 4 depicting a single winged object.

FIG. 8 is a further view of FIG. 4 showing the wings 61 deployed laterally.

Figure 9:
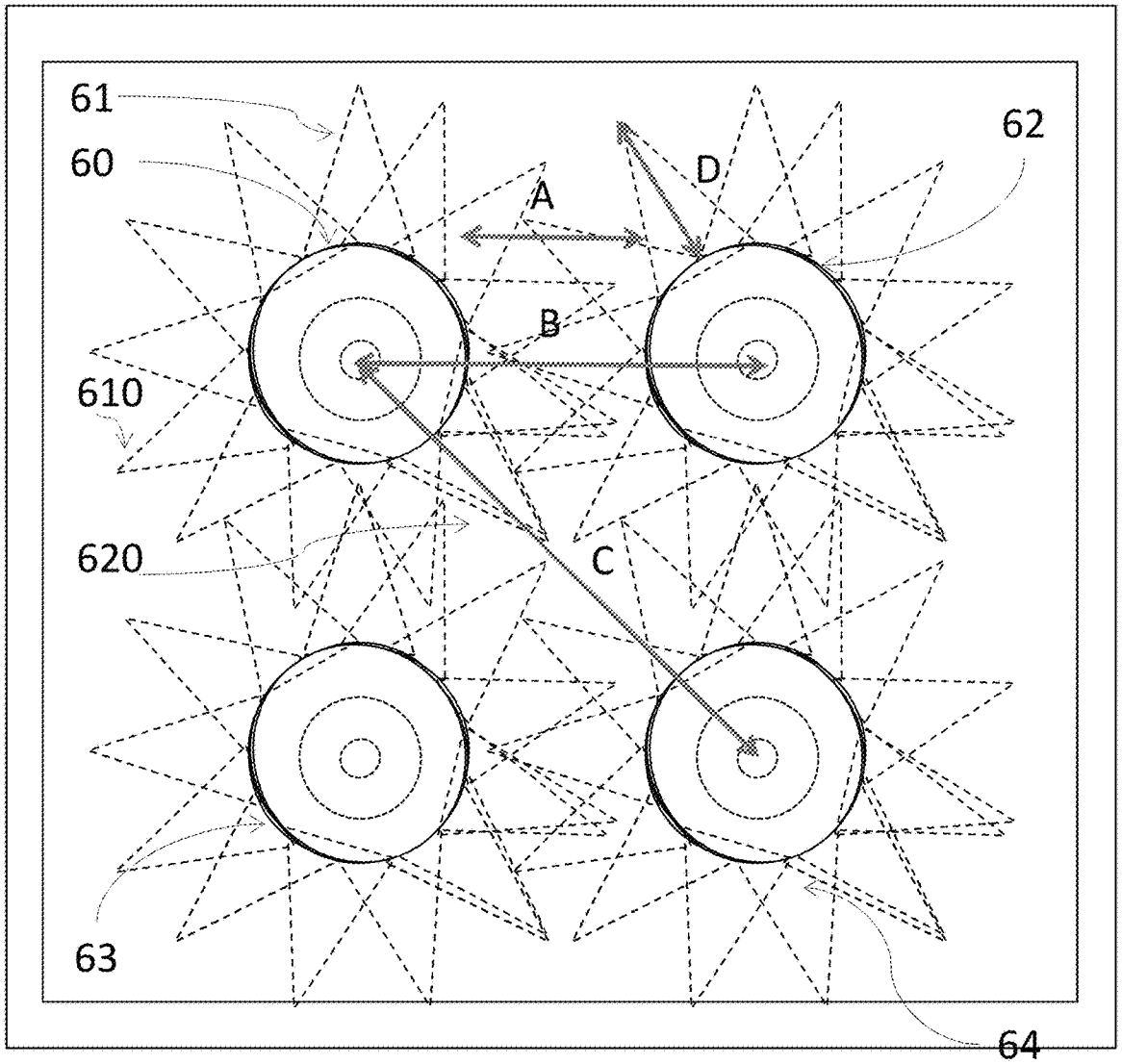
FIG. 9 is a top view depicting four winged objects as they spin on their shafts.

FIG. 9 shows four winged object 60, 62, 63, 64 spinning on their respective shafts 70. In the illustrated embodiment, the shafts 70 are arranged in a circular or substantially circular arrangement. In one or more embodiments, the shafts 70 may be arranged in any other suitable arrangement, such as in a line. FIG. 9 also depicts the distance A between the hub 31 of the first winged object 60 and the hub 31 of the second winged object 62. FIG. 9 also depicts the center-to-center distance B between the first winged object 60 and the second winged object 62. FIG. 9 further depicts the center-to-center distance C between the first winged object 60 and the fourth winged object 64, which is arranged diagonal to the first winged object 60. FIG. 9 also depicts the length D of the wings 61 of the winged objects 60, 62, 63, 64. In one or more embodiments, the lengths D of the wings 61 are greater than half the distance A between the hubs 31 of the first and second winged objects 60, 62 such that the wings 61 of the first winged object 60 overlap with the wings 61 of the second winged object 62 and the wings 61 of the third winged object 63. Accordingly, the first winged object 60 is configured to interfere (e.g., collide) with the downward motion of the second winged object 62 and the third winged object 63 along their respective shafts 70. Accordingly, in one or more embodiments, the spinning toy of the present disclosure features a robust battle environment with the competitors' winged objects delivering powerful strikes against the other winged objects, interfering with their downward motion or "spiral" over and over again, and, optionally, with additional features that cause a winged object to dodge the "attack" of a competitor until a winner emerges.

Figure 10:
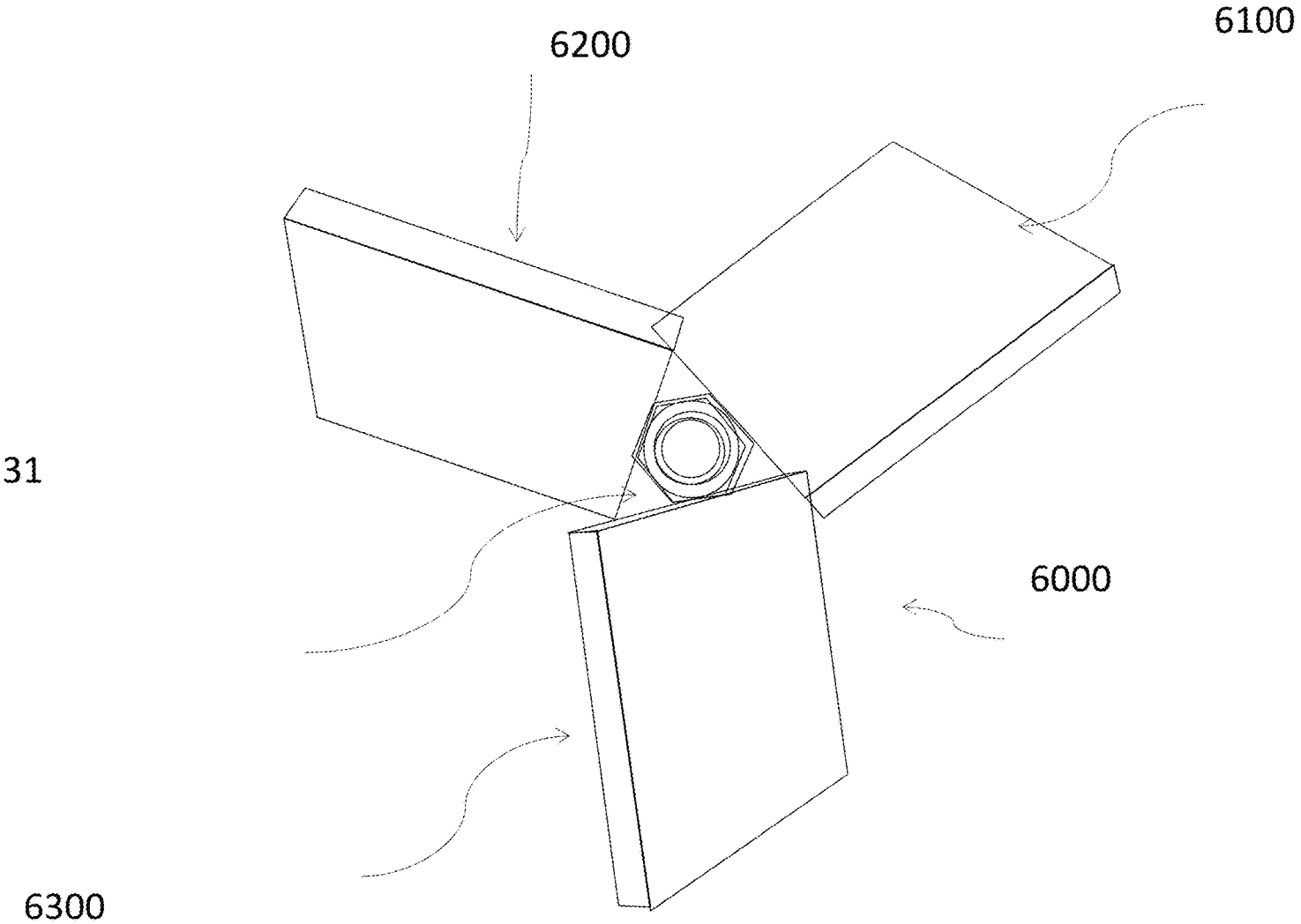
FIG. 10 is a top view of the air-propelled winged-object deploying tilted wings to catch air currents for spin.

FIG. 10 shows another embodiment of the disclosure in which wings 6100, 6200, 6300 of an air-propelled winged object 6000 are constructed as turbines with an aerodynamic design to efficiently harness wind power (e.g., the air-propelled winged object 6000 includes a series of wind driven turbines 6100, 6200, 6300). The air-propelled winged object 6000 may be rotated (e.g., spun) and thereby moved up or down along a shaft 70 by directing air (e.g., from an air blower) onto the air-propelled winged object 6000. The hub, controls, generator, supporting structure and foundation are all aspects of the toy that will be obvious to those with ordinary skill in the art. For example, the specific dimensions and shape of the blades and strength of the materials as well as angle of attack of the blades can be optimized in order to harness force from the air. Vortex generators (VGs) may be used to control the lift characteristics of the blades. The VGs are placed on the airfoil to enhance the lift if they are placed on the lower (flatter) surface or limit the maximum lift if placed on the upper (higher camber) surface. Furling to decrease the angle of attack, which reduces the induced drag from the lift of the rotor, as well as the cross-section, can be employed. Furling can be incorporated to prevent the blades from turning too fast as a safety mechanism for safe play. Loads can be reduced by making the structural system softer or more flexible. This could be accomplished with downwind rotors or with curved blades that twist naturally to reduce angle of attack at higher wind speeds. These systems which are nonlinear can couple the structure to the flow field. In one embodiment, the toy may include a series of air-propelled winged objects 6000 that are utilized in a gaming environment to drive the winged objects 6000 up and down a shaft for the purpose of competing to be the first winged object 6000 to reach, for example, the bottom of the shaft through deployment of air to manipulate the winged objects up and down their respective shafts.

The wings 6100, 6200 and 6300 may be constructed from wood, plastic, metal, alloys, etc. and, in one or more embodiments, are tilted 35-80 degrees from level. The air-propelled winged-object 6000 may work with or without a launcher and may instead use air currents to propel the winged object up or down the main shaft 70. The hub 31 connects the wings 6100, 6200, 6300 of the air-propelled winged-object 6000 to the shaft 70, similarly to in other embodiments.

Figure 11:
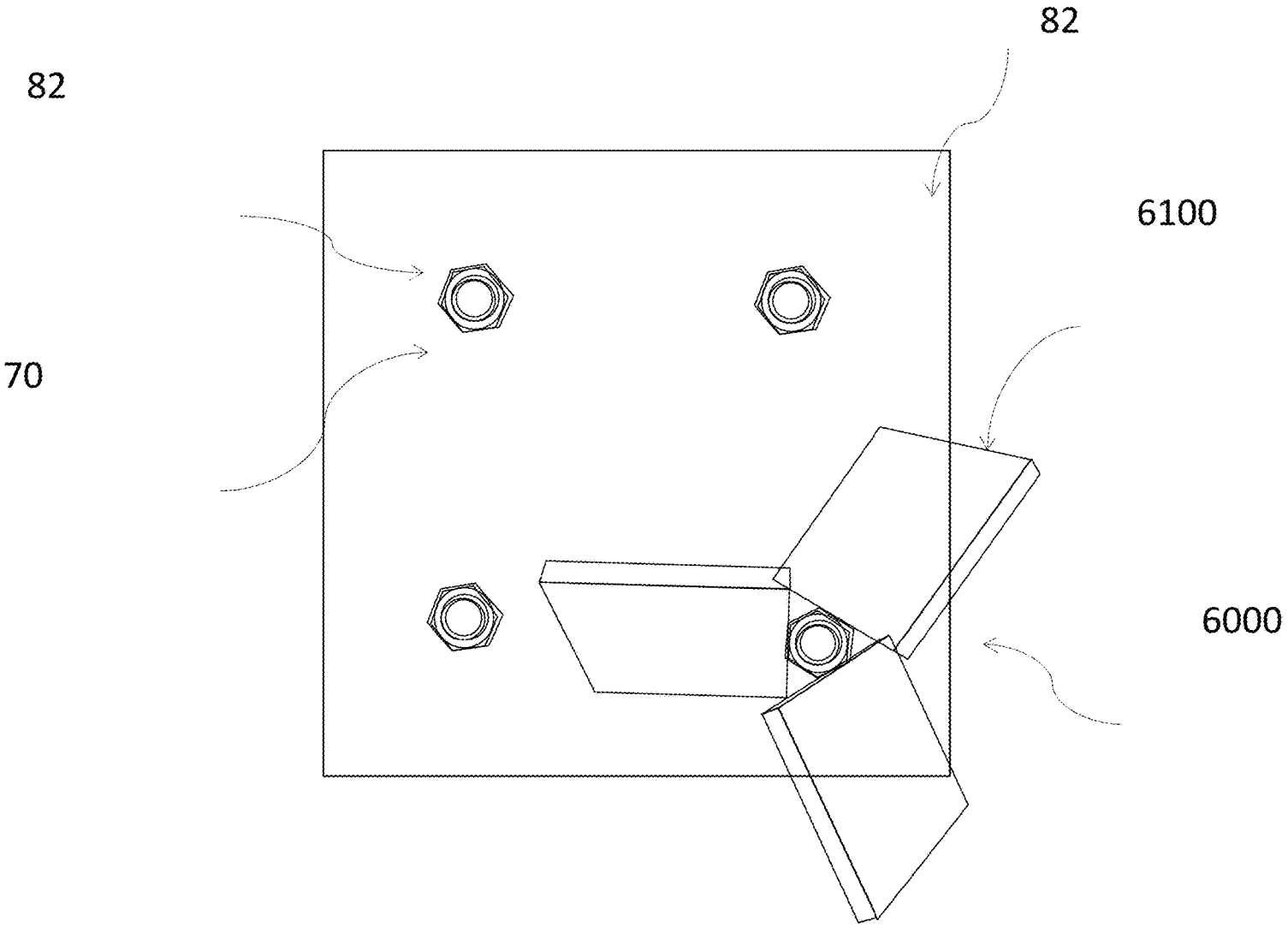
FIG. 11 is a top view of the air-propelled winged-object in the arena.

FIG. 11 shows the air-propelled winged-object 6000 in the arena 80. In the illustrated embodiment, each of the shafts 70 are coupled to a base 82 of the arena 80 with a bolt or other object 82.

Figure 12:
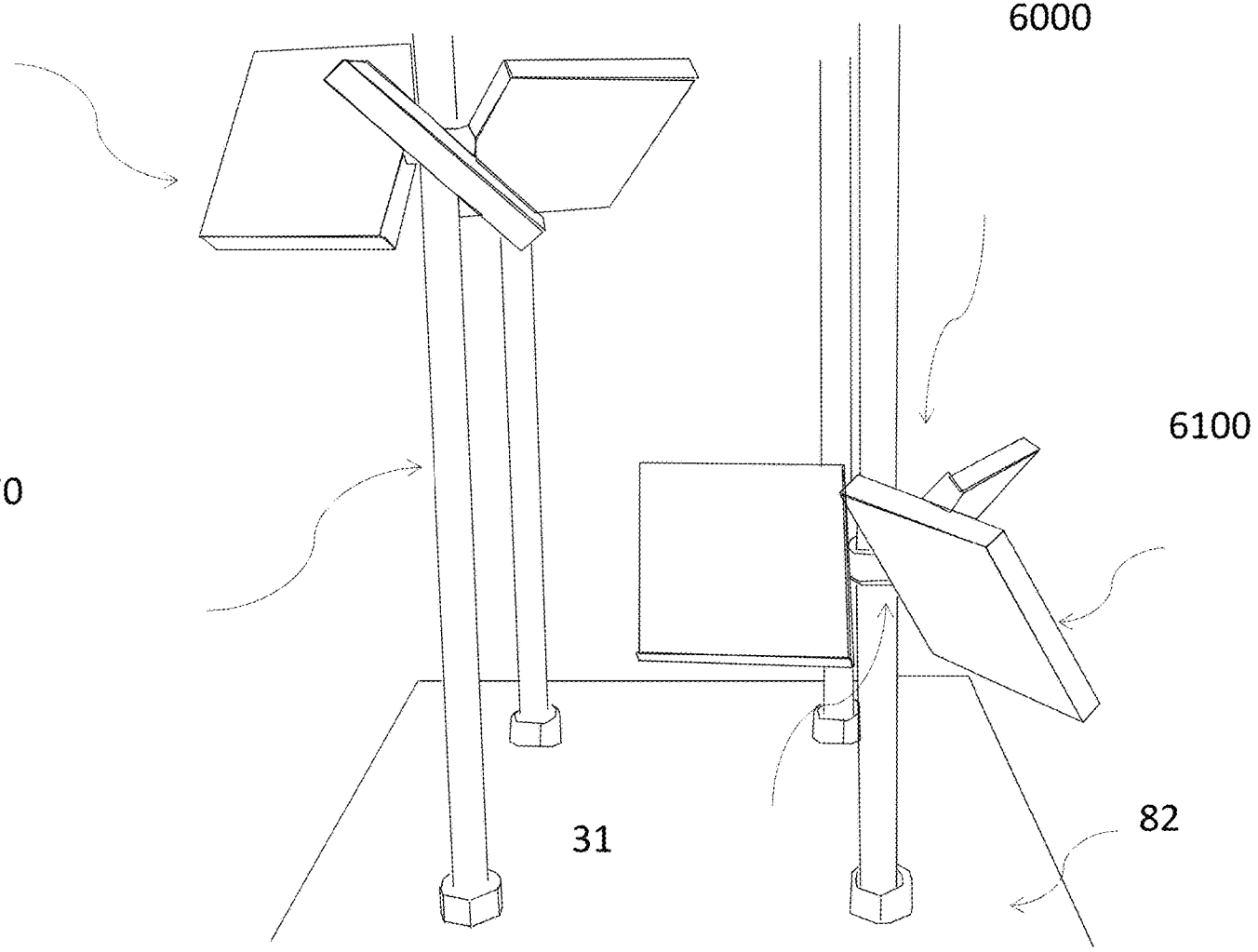
FIG. 12 is a side view of two air-propelled winged-objects at different heights on shafts in the arena.

FIG. 12 shows a side view of two air-propelled winged-objects 6000 that are at different heights on adjacent shafts 70 in the arena 80. This figure helps exemplify the verticality of the air-propelled winged objects 6000.

Figure 13:
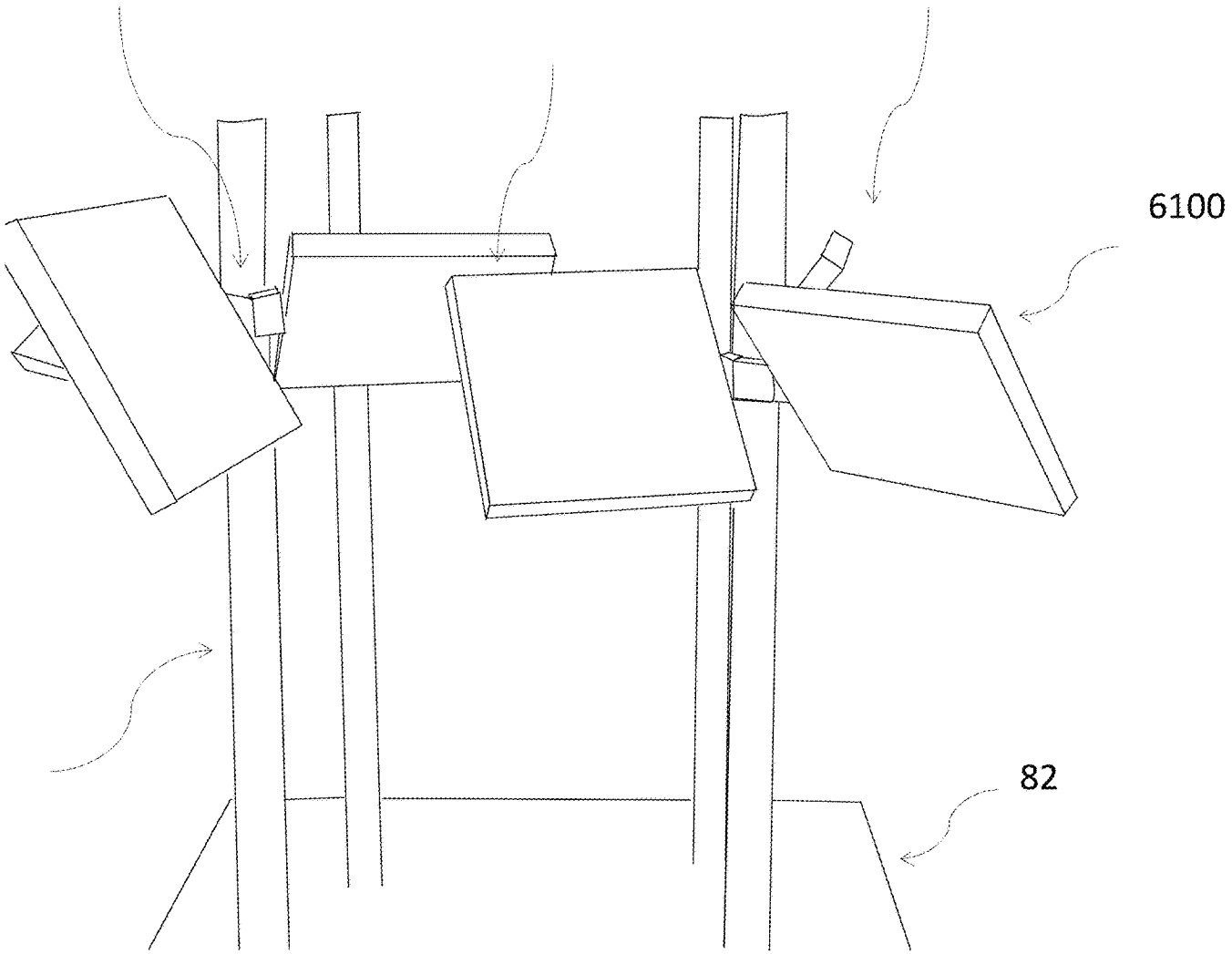
FIG. 13 is a side view of two air-propelled winged-objects colliding in the arena.

FIG. 13 is similar to FIG. 12, however in this figure the air-propelled winged-objects 6000 are colliding at zone N due to being at approximately the same level on the shafts 70. In one or more embodiments, the air-propelled winged-objects 6000 are more likely to collide than the winged objects 60 propelled by the launcher 20.

Figure 14:
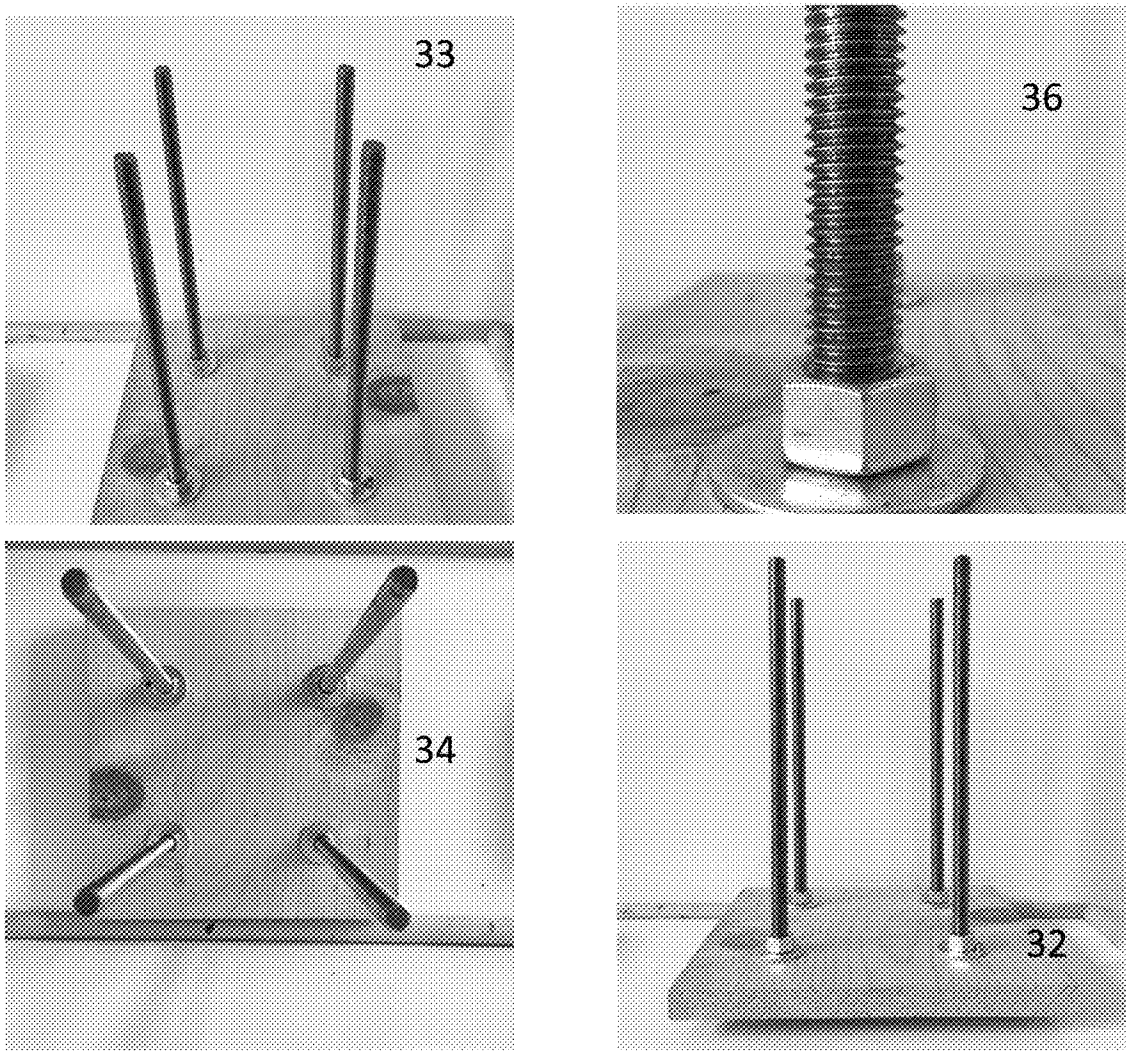
FIG. 14 is a photograph of an arena prototype that was fabricated and tested.
Figure 15:
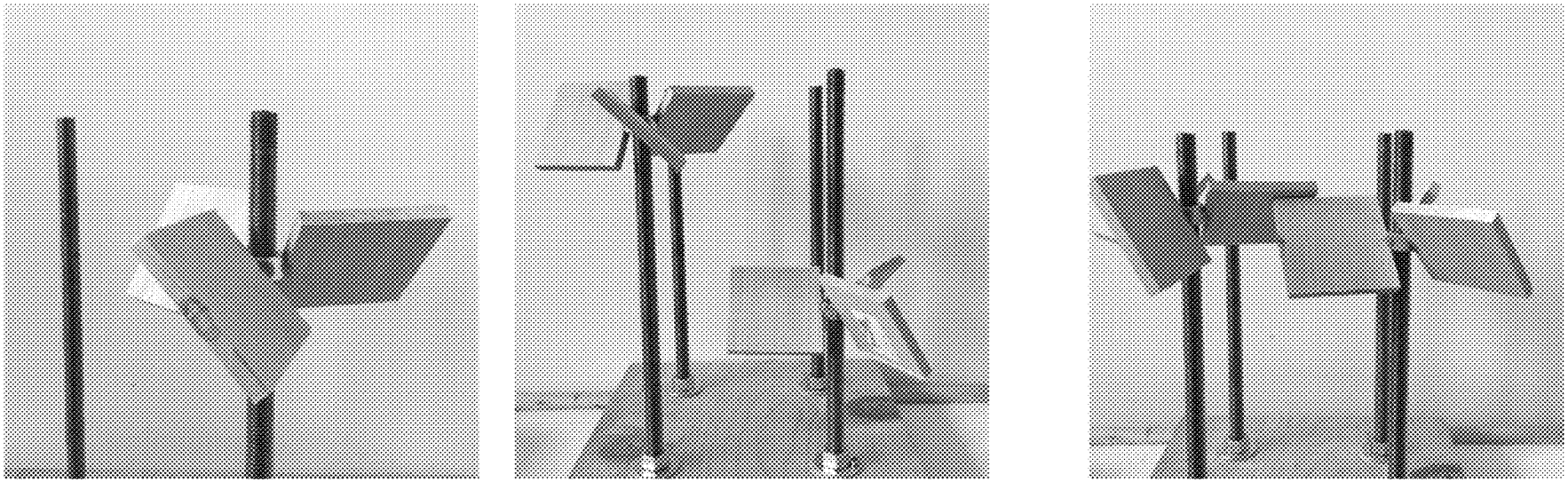
FIG. 15 shows photographs of the air-propelled winged-objects in the arena.

As shown in FIGS. 14-15, an embodiment of the air-propelled winged-object 6000 was produced by cutting out three 2.5" by 2.5" wooden squares forming the wings 6100, 6200, 6300 and then gluing them at an angle to a nut forming the hub. In one or more embodiments of the present disclosure, a mechanism other than nut and threaded rod may be used in which an impediment other than a thread is utilized to inhibit movement of the winged object over the threaded rod. Embodiments include magnetic fields, electromotive forces, friction elements, or other methods known to those skilled in the art. For instance, in one or more embodiments, fixed magnets or electromotive forces are used through incorporation into the winged object and/or other aspects of the arena or wands held by the player to drive the winged objects on the shaft via magnetic fields.

To test the air-propelled winged-object 6000, an embodiment of the arena 80 was produced by drilling holes into a 10" by 10" wooden square base and fitting a ½" threaded metal rod through each hole. Each of the metal rods was fastened to the wooden square base by fitting a combination of bolts and washers on the rod on both sides of the wooden square base. The air-propelled winged-object 6000 was able to spin up and down the metal rod by using a hair blower to create an artificial wind current and a lubricant (e.g., WD-40™) on the metal rods to allow the winged-object 6000 to more smoothly move along the metal rod. Another identical air-propelled winged object 6000 was made and was also able to move up and down a metal rod using the same method. In the illustrated embodiment, the wings of the two air-propelled winged objects overlapped and were able to collide with each other.

Figure 16:
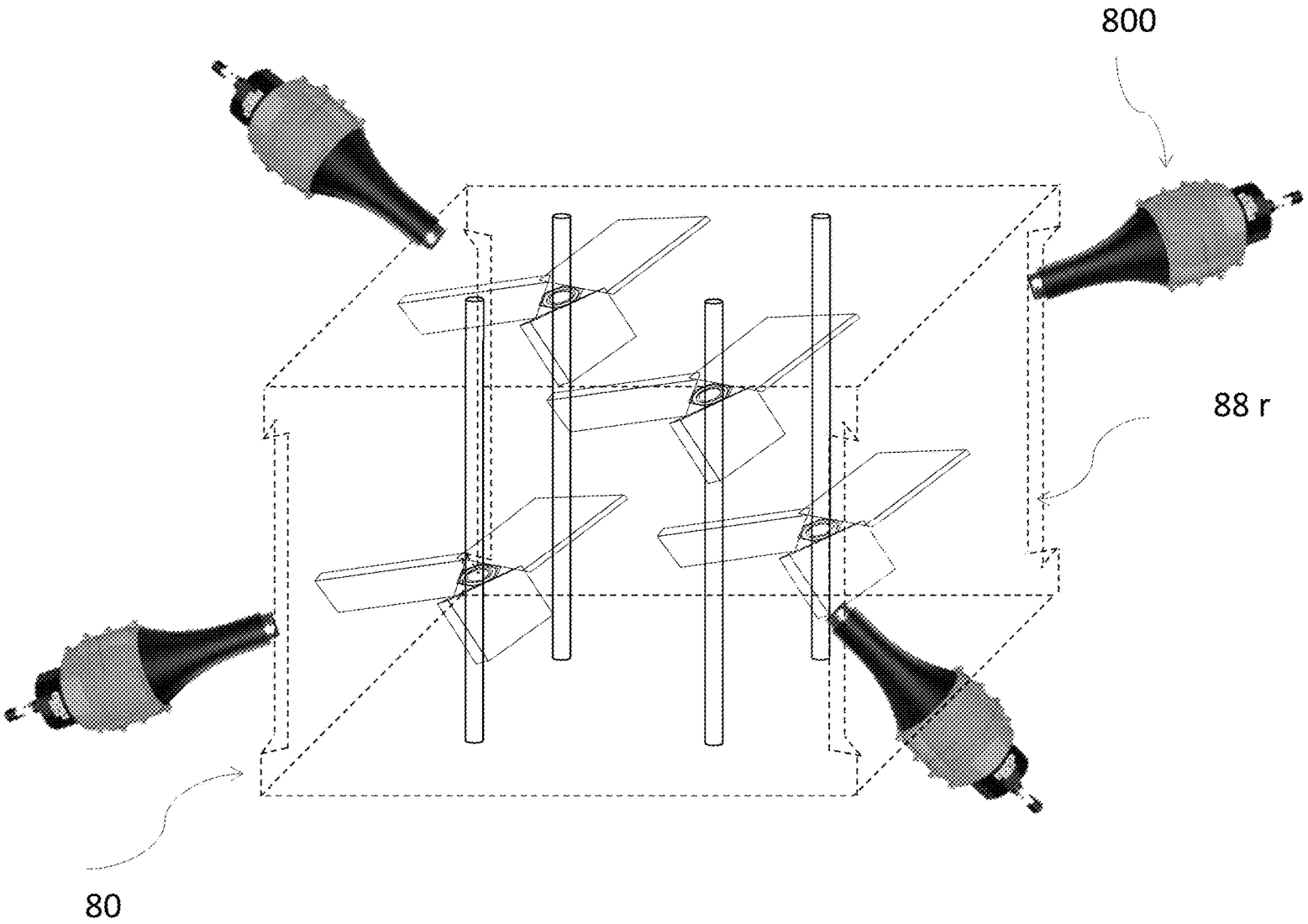
FIG. 16 is a view of an arena for wind-driven winged objects.

FIG. 16 depicts an embodiment in which a series of air blowers 800 are utilized to spin the air-propelled winged objects 6000 and thereby move the air-propelled winged objects 6000 up or down along their respective shafts. In the illustrated embodiment, the arena 80 includes a series of openings 88 (e.g., an opening 88 adjacent or proximate to each shaft) such that the air blowers 800 can direct forced air into the arena 80 and over the turbine blades of at least one of the air-propelled winged objects 600 to drive at least one of the air-propelled winged objects 6000 along one of the shafts (e.g., one of the threaded rods).

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. Although relative terms such as "horizontal," "vertical," "upper," "lower," "inner," "outer" and similar terms have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween.

What is claimed is:

1. A spinning toy comprising:

a base;

at least one shaft coupled to the base;

at least one winged object having a hub and a plurality of wings coupled to the hub, the hub being rotatably mountable on the at least one shaft, the hub defining a plurality of openings; and a launcher configured to rotate the at least one winged object relative to the at least one shaft, the launcher comprising:

a body:

a plurality of blades extending from a first side of the body, the plurality of blades configured to extend into the plurality of openings defined in the hub;

a rotating slider operably coupled to the plurality of blades; and a slider operably coupled to the plurality of blades, wherein, when the hub is rotatably mounted on the at least one shaft and rotated relative to the at least one shaft, the winged object is configured to move along the at least one shaft toward the base.

2. The spinning toy of claim 1, wherein at least a segment of the shaft comprises threads and wherein the hub comprises corresponding threads configured to threadedly engage the threads of the at least one shaft.

3. The spinning toy of claim 1, wherein the at least one shaft comprises a threaded segment and an unthreaded segment, and wherein the threaded segment is between the unthreaded segment and the base.

4. The spinning toy of claim 1, wherein the at least one shaft comprises a plurality of shafts, and wherein the at least one winged object comprises a plurality of winged objects configured to be rotatably mounted on the plurality of shafts.

5. The spinning toy of claim 4, wherein, when a first winged object of the plurality of winged objects is mounted on a first shaft of the plurality of shafts and a second winged object of the plurality of winged objects is mounted on a second shaft of the plurality of shafts, a range of movement of the plurality of wings of the first winged object overlaps with a range of movement of the plurality of wings of the second winged object.

6. The spinning toy of claim 5, wherein movement of one of the first and second winged objects along a corresponding one of the first and second shafts is configured to interfere with movement of the other of the first and second winged objects along the other of the first and second shafts.

7. The spinning toy of claim 1, wherein, when the hub is mounted on the at least one shaft and the plurality of blades are received in the plurality of openings in the hub:

actuation of the rotating slider is configured to build up potential energy in a spring mechanism, and actuation of the slider is configured to withdraw the plurality of blades from the plurality of openings in the hub and to release the at least one winged object from the plurality of blades and allow the at least one winged object to rotate relative to the at least one shaft.

8. The spinning toy of claim 1, wherein the launcher further comprises a glove coupled to a second side of the body opposite to the first side.

9. The spinning toy of claim 1, further comprising at least one spring in the launcher of the at least one winged object, wherein tension from the at least one spring is configured to rotate the at least one winged object relative to the at least one shaft.

10. The spinning toy of claim 1, wherein each wing of the plurality of wings is configured to move between a stowed configuration and a deployed configuration.

11. The spinning toy of claim 10, wherein each wing of the plurality of wings comprises a first segment directly connected to the hub and a second segment coupled to the first segment.

12. The spinning toy of claim 11, wherein the second segment is at least partially telescopically received in the first segment.

13. The spinning toy of claim 11, wherein the first segment is configured to tilt relative to the hub, and wherein the second segment is configured to tilt relative to the first segment.

14. The spinning toy of claim 1, wherein at least one wing of the plurality of wings is a turbine blade, and wherein the at least one winged object is configured to rotate relative to the at least one shaft and move along the at least one shaft when the plurality of wings are subject to an airflow.

15. The spinning toy of claim 1, further comprising electrical conductors to transmit energy from a power source to the at least one winged object to rotate the at least one winged object relative to the at least one shaft.

16. The spinning toy of claim 1, further comprising at least one spring in the hub of the at least one winged object, wherein tension from the at least one spring is configured to rotate the at least one winged object relative to the at least one shaft.

17. A spinning toy, comprising:

a base;

a plurality of shafts coupled to the base;

a plurality of winged objects configured to be rotatably mounted on the plurality of shafts, each winged object of the plurality of winged objects having a hub and a plurality of wings coupled to the hub, the hub of at least one winged object of the plurality of winged object defining a plurality of openings; and a launcher configured to rotate the at least one winged object of the plurality of winged objects relative to at least one shaft of the plurality of shafts, the launcher comprising:

a body:

a plurality of blades extending from a first side of the body, the plurality of blades configured to extend into the plurality of openings defined in the hub;

a rotating slider operably coupled to the plurality of blades; and a slider operably coupled to the plurality of blades, wherein, when the hub of a winged object of the plurality of winged objects is rotatably mounted on a shaft of the plurality of shafts and is rotated relative to the shaft, the winged object is configured to move along the shaft toward the base.

18. The spinning toy of claim 17, wherein, when a first winged object of the plurality of winged objects is mounted on a first shaft of the plurality of shafts and a second winged object of the plurality of winged objects is mounted on a second shaft of the plurality of shafts, the plurality of wings of the first winged object having a range of movement that overlaps with a range of movement of the plurality of wings of the second winged object.

* * * * *